United States Patent [19]

McLaughlin et al.

[11] 3,995,833

[45] Dec. 7, 1976

[54] REMOVABLE GUARD RAIL STANCHION APPARATUS

[75] Inventors: Jack McLaughlin, Orange; John R. McCoy, Carson, both of Calif.

[73] Assignee: Jack McLaughlin, Orange, Calif.

[22] Filed: July 23, 1975

[21] Appl. No.: 598,440

[52] U.S. Cl. ..... 256/59; 256/65; 248/226 A

[51] Int. Cl.[2] ..... E04H 17/14

[58] Field of Search ..... 256/59, 65, DIG. 6, 256/1, 48, 53, 47; 248/226 A, 226 B, 226 C, 228, 229

[56] References Cited

UNITED STATES PATENTS

| | | | |
|---|---|---|---|
| 2,781,687 | 2/1957 | Knocke | 85/62 |
| 3,022,974 | 2/1962 | Knodel | 248/354 S |
| 3,198,470 | 8/1965 | Owens | 248/226 B |
| 3,256,655 | 6/1966 | Teeter | 256/24 |
| 3,747,898 | 7/1973 | Warren | 256/59 |
| 3,756,568 | 9/1973 | Mocny | 256/59 |
| 3,881,698 | 5/1975 | Marsh | 256/59 |

*Primary Examiner*—Werner H. Schroeder
*Assistant Examiner*—Doris L. Troutman
*Attorney, Agent, or Firm*—Gary Appel

[57] ABSTRACT

Removable guard rail stanchion apparatus comprises a clamping portion adapted for clamping to surfaces of a floor edge and a vertical stanchion post having a lower end releasably locked in a socket fixed to the clamping portion. The clamping portions includes larger and smaller diameter vertical tubes, the smaller diameter tube being slidably connected inside the larger diameter tube by an elongate axial screw. Horizontally projecting clamping member is fixed to each of the two tubes. Turning of the axial screw telescopes the tubes and thereby adjusts the spacing between the clamping members which bear against horizontal floor edge surfaces. A dished washer, through which the clamping force is applied, flattens to give a visual indication when sufficient clamping force has been applied, an angle is provided on at least one of the clamping members to fit over a floor edge corner to prevent twisting of the clamping portion relative to the floor edge. In a variation, the two tubes comprising the clamping portion are horizontally disposed, and the clamping members depend therefrom to enable clamping of vertical edge surfaces. The stanchion part may be locked into the clamping portion socket by a removable pin, by a friction lock, or by a socket pin which fits into an inverted L-shaped edge cut out on the post.

25 Claims, 10 Drawing Figures

REMOVABLE GUARD RAIL STANCHION APPARATUS

BACKGROUND OF THE INVENTION

1. Field of the Invention

The present invention relates to the field of temporarily installed guard rail stanchions and, more particularly, to clamp-on type guard rail stancions.

2. Description of the Prior Art

As floors are added in multi-floor building construction, workmen are required to work the floors before walls are installed. To prevent falling of workmen, material and equipment, installation of temporary guard rails around floor perimeters and cut-outs for elevators, stairs, etc., it is now generally mandatory to comply with state and Federal safety regulations.

Several different types of temporary guard rail stanchions or supports have been disclosed. These types include stanchions which require receiving structure to be built into the floor, stanchions which require bolting to floor structure such as wooden beams, and stanchions which clamp on edges of the floor. An example of the first type is Dickey, U.S. Pat. No. 3,584,839; an example of the second type is Gilbert et al., U.S. Pat. No. 3,425,509; and examples of the more common, clamp-on type are Squire, U.S. Pat. No. 3,084,759; Bourn et al., U.S. Pat. No. 3,480,257; Warren, U.S. Pat. No. 3,747,898 and Smith, U.S. Pat. No. 3,841,609.

A number of problems are however, associated with heretofore available or disclosed temporarily installed guard rail stanchions. Stanchion receiving portions required to be built into the floors may be forgotten, damaged or blocked and the stanchions to be received often cannot be properly installed. Similarily mounting holes required for mounting some types of stanchions may be missing or misaligned. Stanchions requiring in-place bolting to wooden members may encounter floors with no wooden members to which the stanchions may be bolted. Even the more generally used clamp-on stanchions present problems. Some types are relatively complex and costly, and are easily damaged, after which their safety is impaired. Others employ small removable parts which may easily be lost, thereby rendering the clamp inoperable or unsafe. Many types require an installer to reach far over the edge to position or actuate the clamp and are thus dangerous to install. All known types are adaptable only for clamping to generally parallel opposing horizontal surfaces. On many occasions, however, the floor edge may be formed of an "I" beam or "U" channel having only parallel vertical clamping surfaces. Also, no known type provides a reliable visual indication when a predetermined clamping force, sufficient to provide safe and secure clamping, has been applied.

These and other problems are compounded by a necessity for removing the entire stanchion assembly, including the mounting portion, in order to provide clearance for receiving large equipment and some types of material. Not only does such removal and reinstallation give rise to the great possibility of lost parts and unsafe installations, but it is also time consuming and thus expensive.

There is known to applicant no types of temporary guard rail stanchions which have post portions which may be readily removed from the mounting portions and reinstalled without disturbing the clamping or securing portions which provide a visual indication of a predetermined clamping force or which may be clamped to vertical surfaces.

SUMMARY OF THE INVENTION

Removable guard rail stanchion apparatus comprises a stanchion and clamping means adapted for clamping to edge portions of a mounting structure. The clamping means includes socket and locking means for releasably mounting a lower end portion of the stanchion, whereby the stanchion may easily be removed from and reinstalled in, the clamping means without disturbing the clamping action. Visual indicating means, associated with the clamping means, indicates when sufficient clamping force is applied to the mounting structure.

More specifically, the clamping means comprises two vertical tubes, one of which slidably fits within the other and which is connected thereto by an elongate axial screw, turning of which causes telescoping of the inner tube within the outer tube. A horizontally projecting clamping member is fixed to each tube, telescoping of the two tubes causing adjusting of the spacing between the clamping members and causing them to clamp horizontal floor edge surfaces. A dished washer mounted on the axial screw flattens when the screw is tightened to give visual indication when sufficient clamping force is applied to the clamping members. A plate, adapted to fit adjacent a floor edge corner, is fixed to at least one of the clamping members to prevent twisting of the clamping means relative to the mounting structure.

In a first variation, the two clamping tubes are horizontally disposed, the clamping members depending therefrom to enable clamping to vertical floor edge surface such as may be encountered at tops of wall sections.

The lower end of the stanchion is locked into a vertical socket, which is fixed to one of the clamping tubes, by a spring loaded pin which is mounted through apertures in the stanchion and the socket. Alternatively, stanchion locking may be accomplished by forcing the end of a shaft threaded through the socket against the stanchion surface, or a projection on the inside of the stanchion may fit into an inverted L-shaped cutout on the bottom edge of the stanchion, locking in the latter case being by inserting the stanchion into the socket and then twisting the stanchion to introduce the projection fully into the cutout.

Rail support members are provided on the stanchions. Angles are provided to support solid rails and eyes or "pigtails" are provided to serve flexible rope or cable rail elements.

In such manner, a removable stanchion assembly is provided which enables clamping onto horizontal or vertical floor edge surfaces, which provides visual indication of sufficient clamping force, and which has a locked, but removable stanchion part which may easily be removed from and reinstalled into, the clamping portion so that rail sections can be quickly and easily removed, for receiving material and equipment upon the floor, without disturbing the clamping action of the clamping portion.

DESCRIPTION OF THE PREFERRED EMBODIMENT

Figure 1:
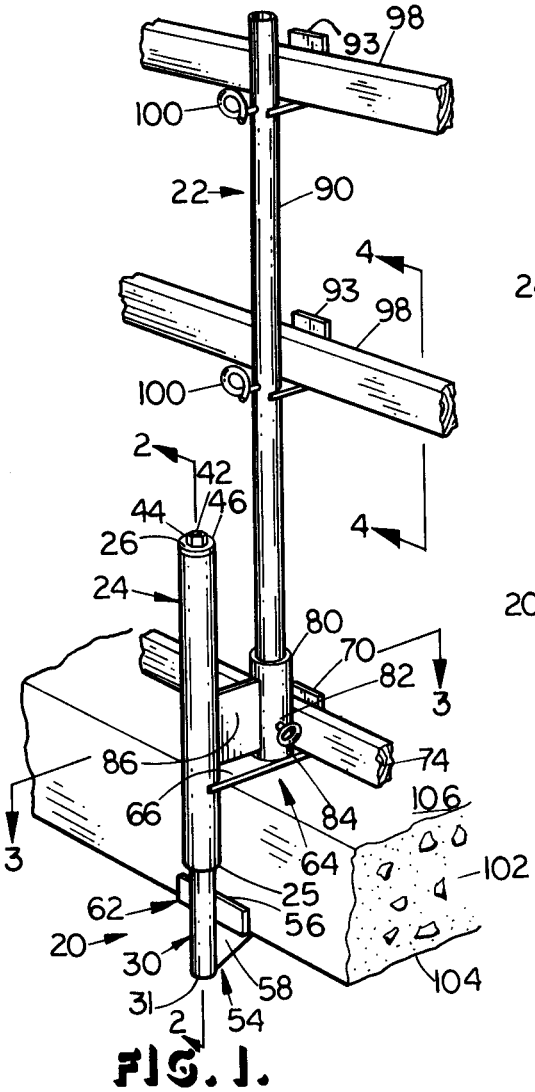
FIG. 1. is a perspective view of the vertical clamp and removable stanchion.
Figure 2:
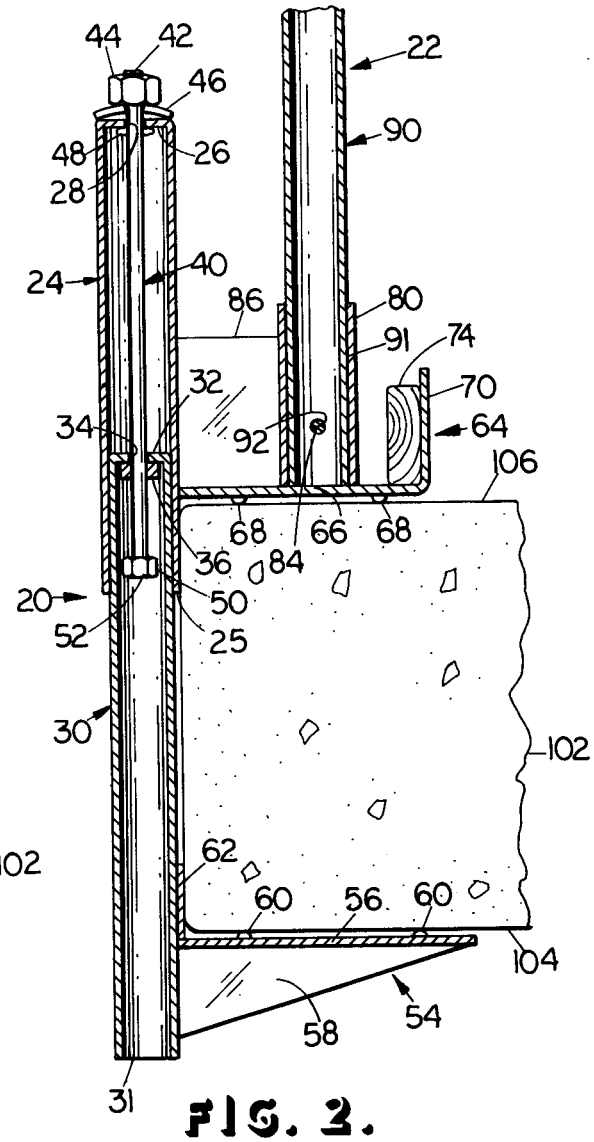
FIG. 2. is a vertical sectional view along line 2—2 of FIG. 1 showing inner portions of the vertical clamp and stanchion mounting.

As best seen in FIG. 1 the removable, clamp on guard rail stanchion comprises generally a clamp portion 20 and a removable stanchion or rail support portion 22 which is installed into the clamp portion. Referring to FIG. 2, the clamp portion 20 includes an elgonate, heavy walled first tube 24 which is open at a lower end 25 and closed at an upper end 26 except for an axially centered screw jack aperture 28. Received within the lower open end 25 of the first tube 24 is a smaller diameter, heavy walled second tube 30 which has an outside diameter slightly smaller than the inside diameter of the first tube so that it may freely slide axially therewithin. A lower end 31 of the second tube 30 is preferably open, to prevent accumulation of water, and an upper end 32 is closed except for an axially centered, threaded aperture 34. A nut or other threaded element 36 may be welded to the inside of the end 32 in registration with the aperture 34.

Connecting the first and second tubes 24 and 30 together is an elongate axial screw or threaded rod 40 which is slightly longer than the first tube. An upper end 42 of the screw 40 projects upwardly through the aperture 28 which is slightly larger in diameter than the screw. A hexigonal nut 44 is threaded onto the end 42 and is welded thereto so that turning of the unit causes turning of the screw.

Mounted on the screw 40 and positioned between the underside of the unit 44 and the upper surface of the first tube end 26 is a dished washer 46, commonly referred to as a Belludle washer, which is slightly smaller in outer diameter slightly than the tube end so that lower edges of the washer bear there against. The function of the washer is to provide a visual indication or the clamping force, as more particularly described below.

To prevent loss of the screw 40, weld beads 48, or other screw retaining means, are formed on the end 42 below the first tube end 26. A lower end 50 of the screw 40 is threaded into the aperture 34 and nut 36 at the upper end of the second tube 30. Turning of the nut 44 in a clockwise direction (as viewed from above) thus causes the screw 40 to draw or telescope the second tube 30 upwardly into the first tube 24. Counterclockwise turning of the nut 44 causes the screw 40 to push the second tube 30 from the first tube 24, thus providing a screw jack action. A nut 52 may be fixedly attached to the end 50 of the screw 40 to prevent the screw from being withdrawn through the nut 36.

Radially projecting outwardly from a lower portion of the second tube 30 is a first clamping member 54 which is welded to the second tube. The member 54 comprises an elongate rectangular upper clamping bar or element 56 and a triangular reinforcing web 58 which projects from the underside of the element 56 to the surface of the tube 30. The member 54 may be formed from a single piece of angle iron, one leg of which is cut at an angle to form the web 58. Two elongate weld beads 60 are formed across the upper surface of the element 56 to enhance the friction gripping properties of the member 54. To prevent rotation of lower portions of the clamp portion 20 during or after installation, a plate 62 is vertically welded at the juncture of the lower tube 30 and the clamp element 56, the axis of the plate being at right angles to such portion and tangential to the tube. Upon installation the plate 62 bears against an edge of the floor.

A second clamping member 64 is radially attached by welding, to a lower region of the first tube 24. The member 64 comprises an elongate angle whose outwardly projection portion 66 has approximately the same length as the element 56 and is parallel thereto. Friction enhancing weld beads 68 are also formed on the lower surface of the portion 66. An upwardly formed, outer end portion 70 of the member 64 has at least one aperture 72 to the clamp portion 20. Thus the toerail 74 remains attached to the clamp portion 20 even when the stanchion portion 22 is removed.

Figure 3:
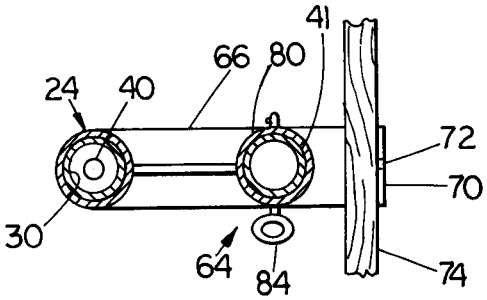
FIG. 3 is a horizontal sectional view along line 3—3 of FIG. 1, showing inner portions of the vertical clamp.

Upon the upper surface of the portion 66, at about the radial center thereof, is welded a vertical stanchion receiving socket 80, which comprises a comparatively short section of tube having an outer diameter preferably equal to that of the first tube 24. An aperture 82 is radially formed through the lower portion of the socket 80 for receiving a spring loaded locking pin 84 (FIG. 3). A rectangular reinforcing web 86 is welded between opposing sides of the first tube 24 and the socket 80 and to the upper surface of the portion 66.

The stanchion portion 22 comprises a long, vertical section of heavy walled stanchion tube 90 having an outer diameter preferably equal to that of the second tube 30 and such that a lower end 91 of the stanchion tube slides easily into the socket 80. An aperture 92, registered with the socket aperture 82 is formed in the lower end of stanchion tube 91 so that the pin 84 may pass through both the socket 80 and the stanchion tube 90 to releasably lock the stanchion tube in the socket.

Figure 4:
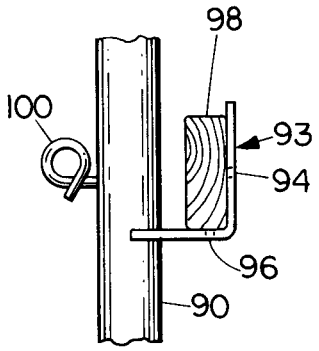
FIG. 4 is a partial vertical view along line 4—4 of FIG. 1, showing rail attachment.

Referring to FIGS. 1 and 4, two rail support angles 92, are radially welded to the stanchion tube 90, a first of such angles is positioned near the upper end of such tube, or about waist high, and the second of such angles is positioned at about the mid height of the tube, or about knee high. At least one aperture 94 is formed in the vertical legs of each angle 93 and another aperture 96 is formed in each horizontal leg, so that rail sections 98 may be secured to the angles (FIG.4) or opposite sides of the tube 90, in opposition to the angles 93, eyes or "pig tails" 100 are attached to the tube to enable attachment of cable guard rail segments (not shown).

Operation of the described clamp on stanchion is apparent from the foregoing description. The screw 40 is turned by the nut 44 to adjust the spacing between the clamp members 54 and 64 so that the clamp portion maybe fit over a mounting structure or floor edge segment 102 (FIGS. 1&2). With the clamp elements 56 and the portion 66 positioned adjacent opposing lower and upper edge surfaces 104 & 106 respectively, the nut 44 is turned clockwise to draw the second tube 30 into the first tube 24, thereby tightening the clamp over the segment 102. When surfaces of the weld beads 60 and 68 contact surfaces 104 and 106 of the segment 102, continued clockwise turning of the nut 44 tightens the clamp and also causes flattening of the dished washer 46 against the tube end 26. When the washer 46 is completely flattened, the clamp is tightly clamped to the segment 102. Visual examination of the washer 46 easily reveals the clamping condition: if the washer 46 is unflattened, the clamp is not securely clamped to the floor segment 102; if it is flattened, satisfactory clamping action is assured.

VARIATION OF FIGURES 5–8

Referring to FIGS. 5–8 a variation of the above described preferred embodiment comprises a temporary clamp-on guard rail stanchion adapted for use with floor structure having parallel vertical, rather than parallel horizontal, clamping surfaces; and includes the previously described stanchion portion 22 and a modified clamping portion 20*a*.

The clamping portion 20*a* utilizes the previously described screw jack action for exerting clamping pressure and includes the first tube 24, second tube 30 which is axially slidable within the first tube, the screw 40 having the nut 44 welded to the end 42 thereof and the dished washer 46 installed between the nut 44 and the first tube end 26. The lower end 50 of the screw 40 is threaded through the second tube end 32 and nut 36 fixed thereto (FIG. 6) The nut 52 is fixed to the end 50.

Figure 7:
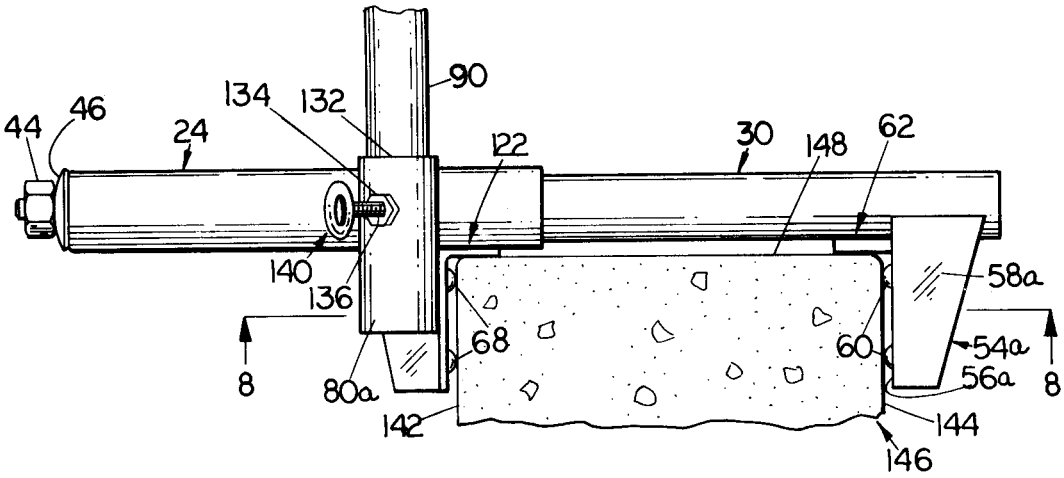
FIG. 7 is a partial vertical view along line 7—7 of FIG. 5, showing the horizontal clamp.
Figure 8:
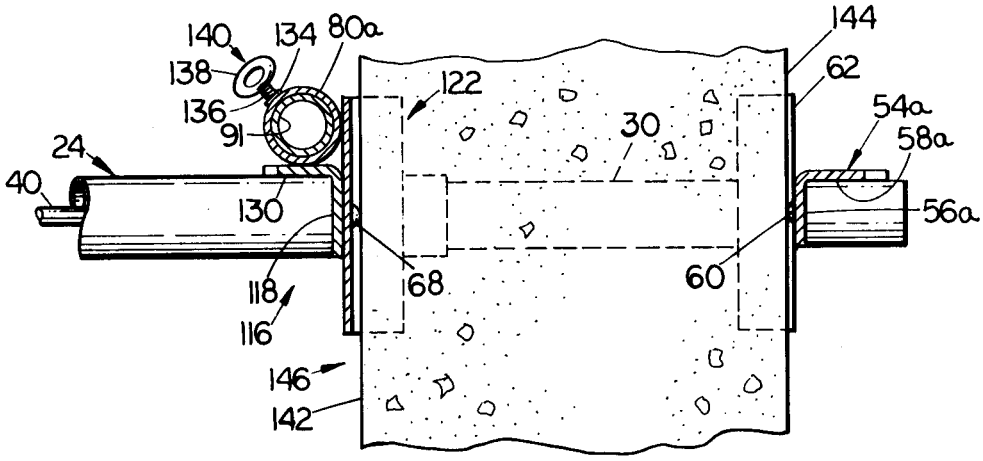
FIG. 8 is a horizontal sectional view along line 8—8 of FIG. 7, showing undersides of the horizontal clamp.

An outer clamp member 54*a* is welded to the second tube 30 to project radially downwardly therefrom (FIG. 7). The member 54*a* may be identical to the described member 54, may be a portion of "U" channel, as shown in FIG. 8, legs 58*a* of the member being parallel to the axis of the second tube 30 to provide reinforcement to the clamping portion 56*a*. Alternatively, the clamp member 54*a* may be identical to the previously described member 54. The plate 62 is welded at the junction of the member 54*a* and the tube 30, as previously described, to prevent twisting of the clamp. Weld beads 66 are formed on the structure contacting surface of the member 54*a* prevent clamp clipping.

Attached, in depending relationship, to the first tube 24, at a lower portion thereof, is an inner clamp member 116 which is generally similar to the member 54*a* and parallel thereto, and which has a portion 118 (FIG. 8) in parallel opposition to the portion 56*a*. A second horizontal plate 122, similar to the plate 62, is welded at the juncture of the portion 118 and the tube 24.

Figure 5:
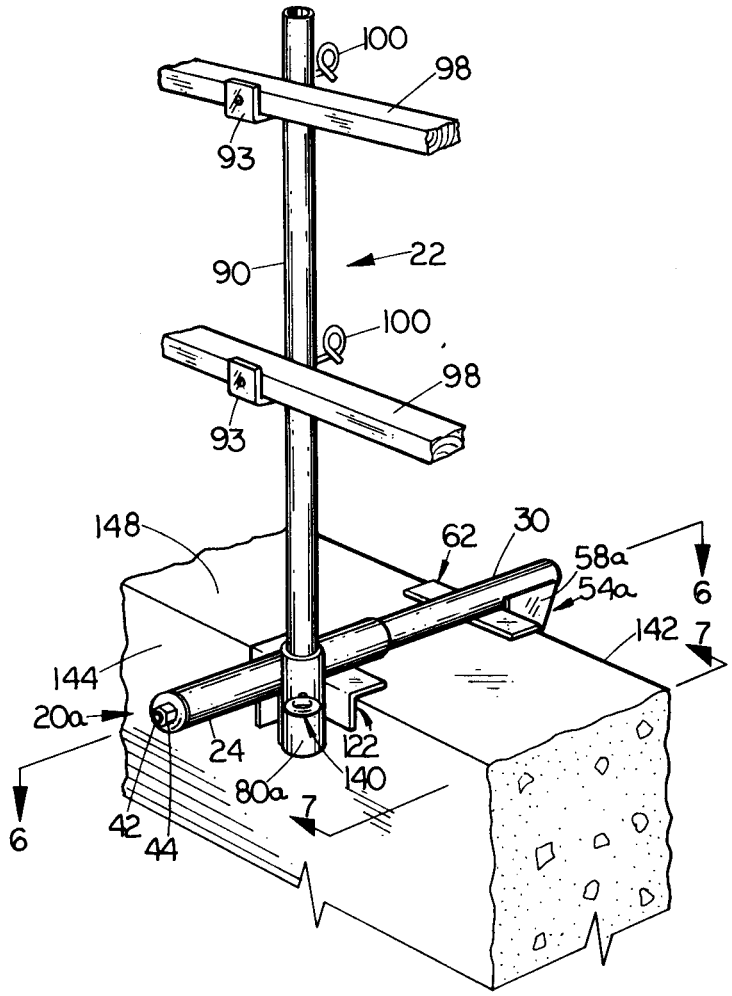
FIG. 5 is a perspective view of the horizontal clamp and removable vertical stanchion.

A stanchion receiving socket 80*a* is welded in a vertical orientation at the juncture between the member 116 and the angle 122, and projects along a side leg 130 of the member 116 (FIG. 8). An upper end 132 of the socket 80*a* is positioned near the horizontal plane through the axis of the first tube 24 (FIG. 7). The lower end 91 of the stanchion tube 90 is inserted into the socket 80*a* and projects upwardly above the upper end 132 thereof. (FIGS. 5 and 7).

Figure 6:
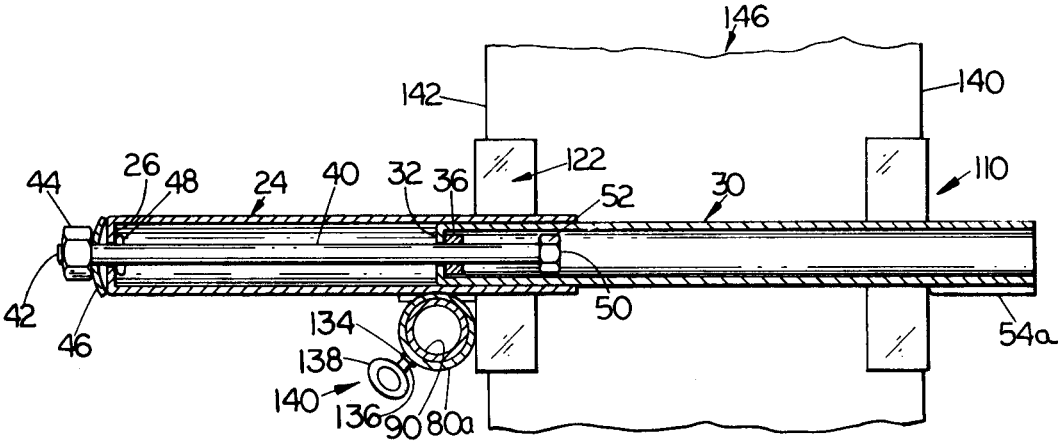
FIG. 6 is a horizontal sectional view along linge 6—6 of FIG. 5, showing inner portions of the horizontal clamp.

FIGS. 6–8 also illustrate an alternative method for removably securing or locking the stanchion 90 into the sockets 80 and 80*a*. An aperture is formed and threaded in an upper portion of the socket 80*a* and a nut 134 is welded in registration with the threaded aperture. Locking of the stanchion tube 90 into the socket 80*a* is provided by a threaded shaft 136 having a handle 138 attached at one end thereof thus forming a T-shaped locking member 140. The end of the shaft 136 is screwed into the nut 134 and aperture in the socket 80*a*. Turning of the handle 138 causes friction locking of the stanchion end 91 in the socket 80*a*. Alternatively, an aperture (not shown) may be formed in the end 91 to receive the end of the shaft 136.

Operation of the clamp portion 20*a* is substantially as described above for the preferred embodiment, except that the clamp members 54*a* and 116 are positioned along vertical surfaces 142 and 144 respectively of, for example, the top of a wall section 146. Under surfaces of the plates 62 and 122 rest upon an upper surface 148 of the section 146 (FIGS. 7 and 8). The plates 62 and 122 preventing twisting of the clamp portion 20*a*.

Figure 9:
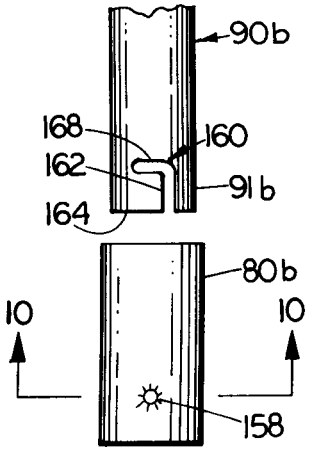
FIG. 9 is a partial, exploded view showing an alternate method of stanchion securing.
Figure 10:
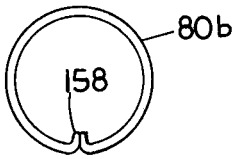
FIG. 10 is a horiztonal sectional view along line 10—10 of FIG. 9, showing the stanchion retaining means.

FIGS. 9 and 10 illustrate a third means for releasably locking the lower end 91*a* of a stanchion tube 90*b* into a socket 80*b*. An inwardly projecting portion 158 is formed in a lower portion of the socket 80*b*. The portion 158 may be dimpled portion of the socket 80*b*, as shown, or may be a pin welded to the socket. An inverted L-shaped cutout 160 is formed at the end 91*b*. A vertical cutout portion 162 of the cutout 160 extends upwardly from a lower edge 164 of the end 91*b* and a horizontal portion 166 extends at right angles to the upper end of the vertical portion.

Upon assembly, the stanchion end 91*b* is inserted into the socket 80*b*, with the vertical cutout portion 162 in line with the socket projecting portion 158, so that the projecting portion enters such vertical portion. The end 91*b* is then lowered as far as possible into the socket 80*b* and pivoted to advance the horizontal portion 168 onto the projecting portion, thereby locking the stanchion 90 into the socket against lifting of the stanchion from the socket.

As an example, the stanchion tube may be four feet long and be formed of a 1 ⅝ such outside diameter by 0.125 inch wall thickness steel tube. The first tube 24 may be about 17 ½ inches long for the vertical clamp and about 13 inches long for the horizontal clamp; both may be of 2 inch outside diameter by 0.120 inch wall thickness steel tube. The second tube 30 may be about 21 inches long for the vertical clamp and about 15 ½ inches long for the horizontal clamp; both may be of 1 ⅝ inch outside diameter by 0.125 inch wall thickness steel tube.

The sockets 80 and 80*a* are about 6 inches long and are of 2 inches by 0.120 inch steel tubing. The clamp members 54, 54*a*, 64 and 118 may project about 6 inches from the sides of the tubes 24 and 30. The vertical clamp may be adjustable from about 4 to 20 inches and the horizontal clamp may be adjusted from about 5 to 15 inches. The screw 40 has ½–13 thread. The Bellville washer is a type B-1000-050 washer.

It is to be appreciated that other means for exerting a clamping pressure may be employed without departing from the scope of the invention. As an illustration, a hydraulic cylinder may replace the first tube 24, its piston replacing the second tube 30 so that pressurized fluid may provide the clamping force; or, various jacking ratchet means may be employed, for said purpose.

Thus the foregoing description is given by way of illustration and example only, it being clearly understood that the scope of the invention is limited solely by the appended claims.

Furthermore, it is to be appreciated, that said clamping portion, can be used independently of the stanchion to effect clamping of lumber, lumber forms, metal forms, miscellaneous layered materials, and the like.

What is claimed is:

1. A removable guard rail stanchion apparatus which comprises:

a. a stanchion having portions thereof adapted for mounting guard rail sections, b. clamping means adapted for clamping to edge portions of a mounting structure, said clamping means including socket means for receiving lower end portions of said stanchion and, c. locking means for releasably retaining said lower end portions in said socket means, whereby said lower end portions may be firmly locked in said socket means and may be unlocked and easily removed thereform and subsequently reinstalled therein without unclamping of said clamping means from a mounting structure.

2. The invention as claimed in claim 1, wherein said clamping means includes spaced, first and second horizontally projecting clamp portions adapted for gripping generally horizontal upper and lower surfaces of a mounting structure.

3. The invention as claimed in claim 2, wherein said spacing between said first and second portions is adjustable in the general range of 4 to 20 inches.

4. The invention as claimed in claim 1, wherein said clamping means includes spaced first and second vertically projecting clamp portions adapted for gripping generally vertical side surfaces of a mounting structure element.

5. The invention as claimed in claim 4, wherein said spacing between said first and second portions is adjustable in the general range of 5 to 15 inches.

6. The invention as claimed in claim 1, wherein said locking means includes a removable pin, said lower end portion of said stanchion and said socket means having apertures therein for receiving said pin.

7. The invention as claimed in claim 1, wherein said locking means includes a handle having a threaded shaft, said socket means having a threaded aperture for receiving said shaft, whereby an end of said shaft may be caused to bear against said end portion of said stanchion received by said socket means for friction locking thereof.

8. A removable guard rail stanchion apparatus which comprises:

a. a stanchion having portions thereof adapted for mounting guard rail sections, b. clamping means adapted for clamping to edge portions of a mounting structure, said clamping means including socket means for receiving lower end portions of said stanchion and, c. locking means for releasably retaining said lower end portions in said socket means, whereby said lower end portions may be firmly locked in said socket means and may be unlocked and easily removed therefrom without unclamping of said clamping means from a mounting structure, said locking means including a projection inwardly directed from said socket means, said lower end portion of said stanchion having an inverted "L" shaped cut out for receiving said projection, whereby said lower end portion may be lowered onto said projection and twisted to lock said stanchion in said socket means.

9. The invention as claimed in claim 1, wherein said clamping means includes friction enhancing means for improving the gripping of said clamping means on a mounting structure.

10. The invention as claimed in claim 9, wherein said friction enchancing means includes a plurality of projections on structure gripping surfaces of said clamping means.

11. The invention as claimed in claim 1, including means for visually indicating when a predetermined clamping force is applied by said clamp to a mounting structure.

12. The invention as claimed in claim 11, wherein said indicating means includes a dished washer cooperating with said clamping means.

13. The invention as claimed in claim 1, wherein said clamping means includes screw jack means for causing clamping action.

14. The invention as claimed in claim 1, wherein said clamping means includes a pressure cylinder and piston and means for applying pressurized fluid to said cylinder for causing clamping action.

15. A temporary guard rail support, which comprises:

a. a removable guard rail post said post including guard rail member attaching means, b. clamping means having adjustable spaced projecting portions adapted for clamping therebetween edge portions of a mounting structure, c. socket means connected to said clamping means for receiving a lower end of said post, d. locking means for releasably locking said lower post end in said socket means, to permit removal of said post from, and reinstallation of said post in said socket means without unclamping said clamping means from said mounting structure and, e. means for visually indicating when a predetermined clamping force is applied by said clamping means to a mounting structure.

16. The invention as claimed in claim 15, wherein said projecting portions of said clamping means are generally horizontal, whereby horizontal surfaces of a mounting structure are clamped.

17. The invention as claimed in claim 15, wherein said projecting portions of said clamping means are generally vertically depending, whereby vertical surfaces of a mounting structure are clamped.

18. The invention as claimed in claim 15, wherein said indicating means includes a dished washer and means for flattening said dished washer when said predetermined clamping force is applied. c 19. The invention as claimed in claim 15, wherein said guard rail attaching means includes at least one bracket for attaching a rigid rail segment to said post.

20. The invention as claimed in claim 15, wherein said guard rail attaching means includes at least one element for attaching a flexible rail segment to said post.

21. The invention as claimed in claim 15, wherein said clamping means includes a first tube having a closed end and an open end and a second tube having a closed end and an open end and major portions slidable within said first tube, and further including screw means connecting said closed ends of said first and second tubes, whereby turning of said screw means causes axial movement of said second tube within said first tube.

22. The invention as claimed in claim 15, wherein said projecting portions of said clamping means have friction enhancing means on structure gripping surfaces to improve clamping action of said clamping means.

23. The invention as claimed in claim 15, including means cooperating with said clamping means to prevent twisting of at least portions thereof when said clamping means are clamped to edge portions of a mounting structure.

24. The invention as claimed in claim 23, wherein said twisting preventing means comprise plates adapted to fit adjacent corners of a mounting structure.

25. The invention as claimed in claim 15, wherein said clamping means includes a first tube and a second tube movable therein, said movement being axial and accomplished by ratcheting means.

* * * * *